US005221018A

United States Patent [19]

Pettersson et al.

[11] Patent Number: 5,221,018

[45] Date of Patent: Jun. 22, 1993

[54] CONTAINER FOR JAMMING MEANS

[75] Inventors: Sven Pettersson, Vällingby; Magnus Schnürer, Älvsjö, both of Sweden

[73] Assignee: NobelTech Systems AB, Jarfalla, Sweden

[21] Appl. No.: 858,540

[22] Filed: Mar. 27, 1992

[30] Foreign Application Priority Data

Mar. 27, 1991 [SE] Sweden ..... 9100914

[51] Int. Cl.[5] ..... B65D 45/28

[52] U.S. Cl. ..... 220/23.4; 220/323; 229/125.23; 229/125.27

[58] Field of Search ..... 220/323, 23.4, 23.82, 220/23.86; 229/125.23, 125.27

[56] References Cited

U.S. PATENT DOCUMENTS

| | | | |
|---|---|---|---|
| 1,217,668 | 2/1917 | Trumbower | 229/125.23 |
| 1,303,489 | 5/1919 | McLaurin | 229/125.23 |
| 1,369,969 | 3/1921 | Fairbanks et al. | 220/323 |
| 2,071,663 | 2/1937 | Smith | 229/125.23 |
| 3,316,571 | 6/1970 | Roper et al. . | |
| 3,746,205 | 7/1973 | Helguera | 220/323 |
| 4,147,276 | 4/1979 | Jordan, Jr. | 220/323 |
| 4,150,760 | 4/1979 | d'Orgelys | 220/323 |
| 4,272,010 | 6/1981 | Capo | 229/125.27 |
| 4,320,851 | 3/1982 | Montoya | 220/323 |

FOREIGN PATENT DOCUMENTS

| | | |
|---|---|---|
| 0127218 | 3/1984 | European Pat. Off. . |
| 0278568 | 2/1988 | European Pat. Off. . |

*Primary Examiner*—Joseph Man-Fu Moy
*Attorney, Agent, or Firm*—Pollock, Vande Sande & Priddy

[57] ABSTRACT

A container assembly for housing a jamming device includes a box having a bottom section, a wall extending from and surrounding the bottom section and an opening for insertion of the jamming device into the box. The box or a frame, dimensioned to receive the box therein, includes coupling members for interconnection of another container thereto. A lid is applicable above the box to substantially cover its opening. A locking assembly includes a first locking member provided on the lid which cooperates with a second locking member on the box or the frame. This locking assembly cooperates with a locking assembly of the other container when interconnected through the coupling members to maintain the lid fixedly positioned to cover the opening.

10 Claims, 3 Drawing Sheets

CONTAINER FOR JAMMING MEANS

FIELD OF THE INVENTION

The present invention relates to a container for jamming means, such as radar chaff, or IR-burning bodies, and intended to be brought with a craft and to be dispensed from the same for the purpose of diverting or other purpose, the container comprising a box provided with an opening, the box having an essentially flat bottom section with a surrounding wall and containing said jamming the box or a frame dimensioned to receive the box is connectable with similar boxes or frames, respectively, in connection to the opening and the bottom section of the box.

BACKGROUND OF THE INVENTION

Jamming means to be housed in the container refer to both active jamming means, such as IR-burning bodies and passive jamming means, such as radar chaff. Other examples of jamming means are smoke delivering means and radar reflectors.

A container according to the above is previously known from SE B 8700504-7. Commonly, such containers are put together into long rows. The outermost container at one of the ends of such a row is not able to keep its contents of jamming means without special measures. This is not a great problem as long as the containers are kept together in long rows and the outermost open container is left unfilled.

In certain connections, however, it is desirable to divide the row into shorter rows, for example to optimize the filling of a container magazine in a dispenser. This situation may occur for example, when the standard length of the container rows or a multiple of such length is not adapted to the length of the container magazine of the dispenser or when container magazines are to be filled which are only partly emptied at a preceding activation of the dispenser.

SUMMARY OF THE INVENTION

It is an object of the present invention to obtain containers intended for jamming means, facilitating optimal filling of the container magazine of the dispenser and the containers of which during the handling up to the release of the container from a dispenser keep the jamming means in position, thereby preventing unintentional spreading and unnecessary waste.

The object of the invention is obtained by means of a container including a lid appliable above the opening of the box in a way keeping the lid fixed in order to essentially cover the opening of the box. By arranging a fixedly kept lid, a row of containers may be divided into a number of shorter rows without that waste of counter means occur. Thereby the length of the rows may be adapted to the length of the container magazine. Unintentional dividing of standardized container rows also does not cause any waste.

According to a favorable embodiment of the present invention the lid of the container is arranged to be fixed above the box by cooperation with a similar container connected adjacent to the bottom section of the box.

According to another favorable embodiment, the lid comprises locking means for locking the lid above the opening of the box.

Preferrably, the locking means is a locking strip and according to a special embodiment, the locking strip is provided with at least one bulge in each end. The locking strip enables a simple fixed keeping of the lid above the box and the bulges on the strip contribute to a simple and effective fixed keeping.

According to an embodiment, the container is characterized in that the surrounding wall of the box or the periphery of the frame is provided with loop means for cooperation with the locking means of the lid, the locking means and the loop means in cooperation keeping the lid fixed above the box when the box or the frame is connected to a similar box or frame adjacent to the bottom section of the box. The loop means in cooperation with the locking means provide very reliable fixed keeping of the lid of the container when it is connected to a container situated behind at the same time as the lid may be easily released from the container when the container has been released from the container behind.

The present invention will be described below in more detail by way of example with reference to the accompanying drawings in which:

DETAILED DESCRIPTION OF THE INVENTION

Figure 1:
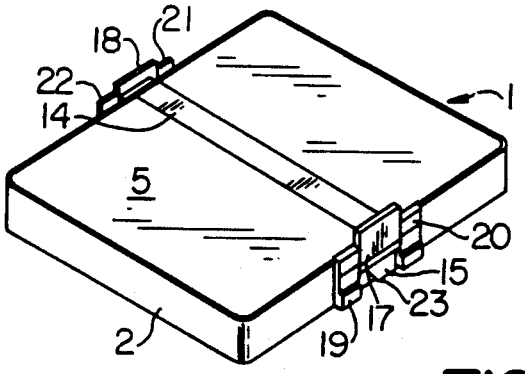
FIG. 1 shows a first embodiment of a container according to the invention in a perspective view.

A first embodiment of a container 1 is described below with reference to FIGS. 1–6. The container comprises, as apparent from the exploded view of FIG. 2, a frame 2, a box 3 also called an insertion box, jamming means 4 and a lid 5.

The shown frame 2 is formed by essentially four angular like elements 6.1–6.4 which together with two cross beams 7.1, 7.2 are arranged to define a space dimensioned to allow insertion of the box therein 3. Loop means 17, 18 are provided on the outside of two parallel angular like element 6.1, 6.3 included in the frame 2. The task of the loop means will be described in more detail later. On each side of the loop means 17, 18, the frame of the container is provided with coupling means 19–22 enabling coupling together of several containers 1. The coupling means 19–22 will as well be later described in more detail.

Figure 2:
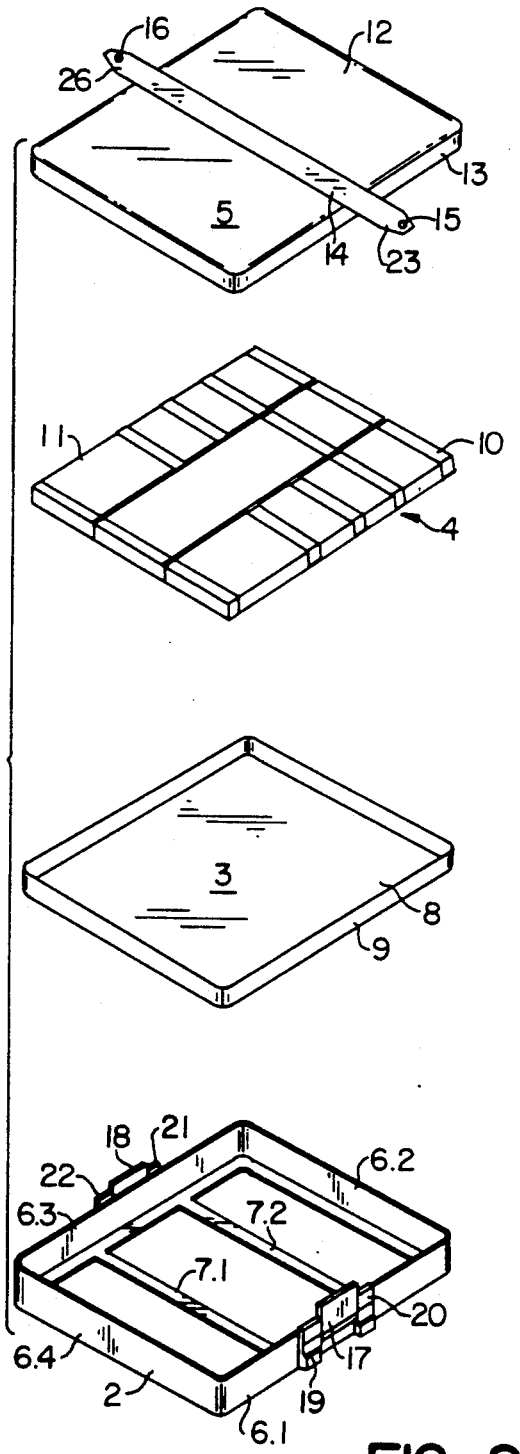
FIG. 2 shows the container according to the first embodiment in an exploded view.
Figure 5:
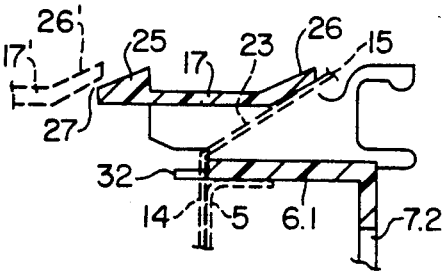
FIG. 5 shows a section taken along the lines 5—5 in FIG. 4 of a part of the container.

In the shown first embodiment the box is constituted by an essentially flat bottom section 8 having a rectangular shape surrounded by a surrounding wall 9. The box 3 is intended to contain jamming means 4 and in the present case radar chaff 10. The chaff is divided into a number of chaff packets by means of wrappers. The chaff packet may have different lengths and four different lengths are shown in FIG. 2. Due to that fact a wide frequency range may be covered.

The lid 5 has a shape similar to the box 3, that is an essentially flat top rectangular section 12 surrounded by a surrounding wall 13. On the upper side of the lid there is provided a locking strip 14. The locking strip 14 may be integral with the lid 5, but in the shown embodiment it is glued to the upper side of the lid. In each end 23, 24 of the locking strip 14 a bulge 15 or 16, respectivily, is shaped. The locking operation of the locking strip will be apparent from the description further on below.

A complete container 1 is suitably put together according to the following. The box 3 is filled with chaff 10, possibly divided into packets by means of wrappers. Thereafter the box filled with chaff is inserted into the space defined by the frame 2. Finally, the lid 5 is applied above the box 3. It is thereby ensured that the ends 23, 24 of the locking strip 14 are introduced between the respective loop means 17, 18 and the two adjacent angular like element 6.1 and 6.3. By means of the above measures the container 1 assumes the condition shown in FIG. 1. The bulges 15, 16 in the ends 23, 24 of the locking strip 14 in cooperation with the loop means 17, 18 keep the lid in position. A suitable embodiment of the loop means may result in that they furthermore cooperate with the loop means in adjacent containers. Such a suitable loop embodiment is shown in more detail in the FIGS. 3-5.

In the following embodiment of the frame according to the first embodiment will be described in more detail with reference to FIG. 3-6.

Figure 3:
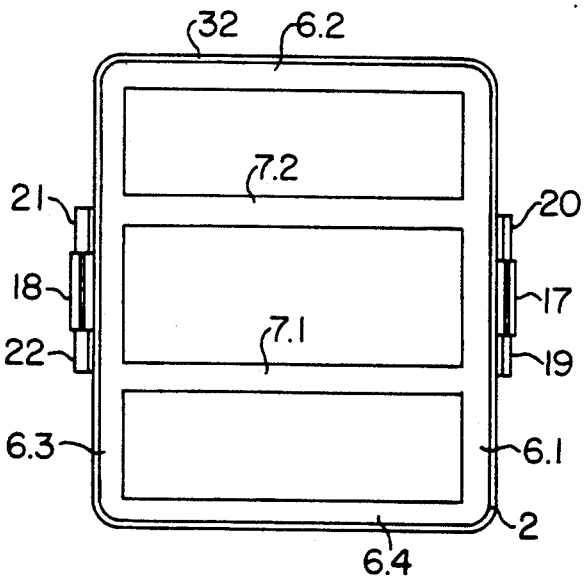
FIG. 3 shows a part of the container according to the first embodiment in a front view.
Figure 4:
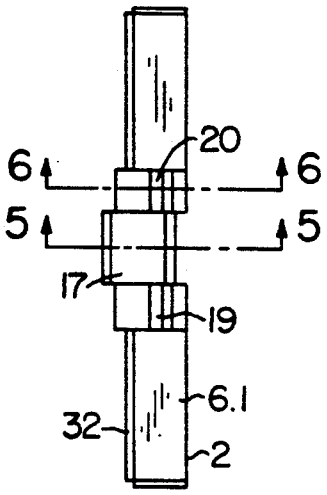
FIG. 4 shows a part of the container according to the first embodiment in a side view.

A front view of the frame 2 is shown in FIG. 3. The loop means 17, 18 are provided on the outside of two of the parallel angular like elements 6.1, 6.3 of the frame as well as the coupling means 19-22 for connecting adjacent frames. The shape of the loop means is most evident from the side view according to FIG. 4 and the section shown in FIG. 5 taken along the lines 5—5 in FIG. 4. In its front section the loop means have a wedge shape 25, while the rear section have a deflection 26. The deflection 26' of the rear section of a loop means 17' of a frame connecting at the side of the opening of the frame 2 essentially coincides with the wedge shaped inclination of the front section. A narrow slot 27 is obtained between the two adjacent loop means 17, 17' and the locking strip runs through this slot. Due to the presence of the bulges 15, 16 in the ends 23, 24 of the locking strip, the slot 27 prevents the locking strip and thereby the lid to be released from the container as long as the frame and thereby the container are connected to a frame positioned behind.

Figure 6:
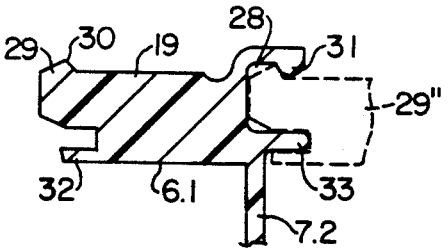
FIG. 6 shows a section taken along the lines 6—6 in FIG. 4 of a part of the container.

FIG. 6 shows a coupling means 19 for coupling together adjacent frames. The rear section of the coupling means shows a groove like opening 28 adapted to receive a pin shaped means 29. In the figure the pin shaped means situated behind has been indicated with broken lines and has been given the reference numeral 29''. Each pin shaped means 29 has a projecting head 30 as well as each opening comprises a projection 31. By means of the described embodiment of coupling means 19, a reliable connection of adjacent containers is obtained.

In order to obtain a favorable connection between adjacent frames, the frames have thinner front and rear section 32, 33. The thinner sections are designed in such a way that two adjacent frames may be displaced into each other.

Figure 7:
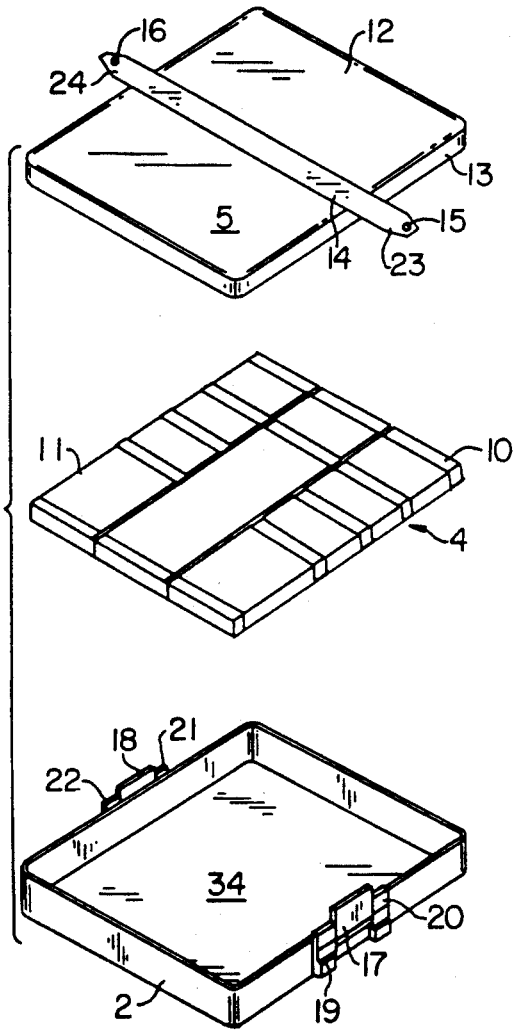
FIG. 7 shows a second embodiment of a container according to the present invention in an exploded view.

FIG. 7 shows a second embodiment of the container according to the present invention. This embodiment differs from the previously described first embodiment in that the frame and the box have been replaced by a box 34 on the periphery of which loop means 17, 18 and coupling means 19, 20 have been directly applied. As to the rest the included element have correspondence in the embodiment described with reference to FIGS. 1-6. The corresponding elements have been given the same reference numerals through out all the text.

In a modification of the second embodiment it is possible to introduce a box 3 according to the first embodiment as an insertion box provided in the box 34.

Figure 8:
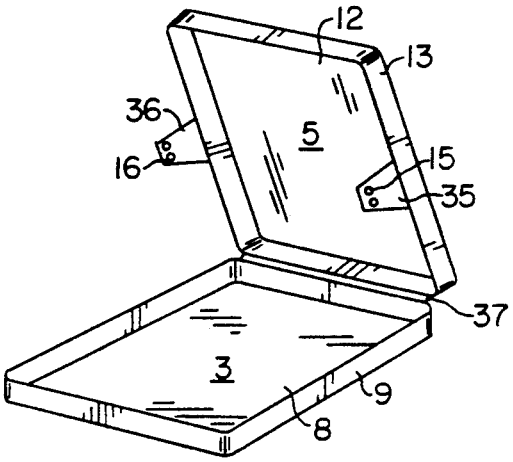
FIG. 8 shows an alternative lid and box included in a container according to the present invention; and, FIG. 9 shows a number of containers according to the first or second embodiment connected into a row.

A lid 5 and a box 3 included in the container 1 may, as is shown in the embodiment according to FIG. 8, be connected to each other by means of a joint. A joint 37 is provided between one of the wall sections of the box 3 and a corresponding wall section of the lid 5. The locking means consist of two lugs 35, 36 emanating from the wall 13 of the lid. The two lugs are provided with bulges 15, 16.

Figure 9:
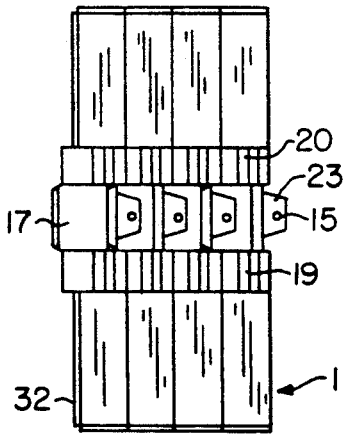

A number of containers 1 connected in a row are shown in FIG. 9. The container 1 may either be of the kind described with reference to the FIGS. 1-6 or the embodiment shown in FIG. 7. Independently of in what position such a row is divided, the lids of the containers are held in position above the container openings as long as at least two containers are kept together by means of the coupling means.

We claim:

1. A container assembly for housing a jamming device, said assembly comprising:

a box having a bottom section, a wall extending from and surrounding said bottom section and an opening for insertion of the jamming device into said box;

at least one of said box and frame, dimensioned to receive said box therein, including coupling means for interconnection with at least one box and frame of another container;

a lid applicable above said box to substantially cover said opening of the box; and a locking assembly including first locking means provided on said lid which cooperates with a second locking means on at least one of said box and said frame said locking assembly cooperating with another locking assembly of said another container when interconnected through said coupling means to maintain said lid fixedly positioned to cover said opening.

2. A container as claimed in claim 1, wherein said first locking means provided on said lid is a locking strip.

3. A container as claimed in claim 2, wherein said locking strip is provided with at least one bulge.

4. A container as claimed in claim 1, wherein the lid is made of a deformable plastic.

5. A container as claimed in claim 3, wherein said second locking means includes a pair of loop members, each provided on the opposite sides of one of said box and frame and adapted for receiving ends of said locking strip.

6. A container assembly for housing a jamming device, said assembly comprising:

a box having a bottom section, a wall extending from and surrounding said bottom section and an opening for insertion of the jamming device into said box;

a frame dimensioned to receive said box therein, said frame including coupling means for interconnection with at least one frame, of another container;

a lid applicable above said box to substantially cover said opening of the box; and a locking assembly including first locking means provided on said lid which cooperates with a second locking means on said frame, said locking assembly also cooperating with another locking assembly of said another container when interconnected through said coupling means to maintain said lid fixedly positioned to cover said opening.

7. A container as claimed in claim 6, wherein said first locking means provided on said lid is a locking strip.

8. A container as claimed in claim 7, wherein said locking strip is provided with at least one bulge.

9. A container as claimed in claim 6, wherein the lid is made of a deformable plastic.

10. A container as claimed in claim 8, wherein said second locking means includes a pair of loop members, each provided on the opposite sides of said frame and adapted for receiving ends of said locking strip.

* * * * *